US007143681B2

(12) United States Patent
Hartmann et al.

(10) Patent No.: US 7,143,681 B2
(45) Date of Patent: Dec. 5, 2006

(54) FIRING DIRECTION SYSTEM FOR A ROCKET LAUNCHER

(75) Inventors: Wilfried Hartmann, Kassel (DE); Timo Rinke, Staufenberg (DE); Bernhard Stehlin, Leinfelden-Echterdingen (DE); Andreas Noll, Dettenhausen (DE)

(73) Assignee: Krauss-Maffei Wegmann GmbH & Co. KG (DE)

( * ) Notice: Subject to any disclaimer, the term of this patent is extended or adjusted under 35 U.S.C. 154(b) by 273 days.

(21) Appl. No.: 10/483,588

(22) PCT Filed: Jan. 28, 2003

(86) PCT No.: PCT/DE03/00220

§ 371 (c)(1),
(2), (4) Date: Jan. 9, 2004

(87) PCT Pub. No.: WO03/064958

PCT Pub. Date: Aug. 7, 2003

(65) Prior Publication Data

US 2004/0200345 A1 Oct. 14, 2004

(30) Foreign Application Priority Data

Feb. 1, 2002 (DE) ..... 102 04 052

(51) Int. Cl.
*F41A 27/00* (2006.01)

(52) U.S. Cl. ..... 89/41.02; 89/1.815; 235/404

(58) Field of Classification Search ..... None
See application file for complete search history.

(56) References Cited

U.S. PATENT DOCUMENTS 3,865,009 A * 2/1975 Kongelbeck ..... 89/1.815
4,302,666 A * 11/1981 Hawkins ..... 235/404
4,353,446 A * 10/1982 Wilken et al. ..... 192/21
4,482,848 A * 11/1984 Heal et al. ..... 318/98
6,820,531 B1 * 11/2004 Cianciolo ..... 89/41.02
7,036,639 B1 * 5/2006 Exely et al. ..... 188/137

* cited by examiner

*Primary Examiner*—Michelle Clement
(74) *Attorney, Agent, or Firm*—Robert W. Becker & Associates; Robert W Becker

(57) ABSTRACT

The invention relates to a firing direction system for adjusting a rocket launcher, and includes a drive motor (9) that is connected via a safety brake (2-8) with a drive shaft (1) for adjusting the rocket launcher, whereby a rotation of the drive shaft (1) in a first direction effects a raising of the rocket launcher, and a rotation in the opposite direction effects a lowering of the rocket launcher, whereby the safety brake prevents a back-driving torque of the rocket launcher from effecting a rotation of the drive shaft (1) in the opposite direction. In addition, an electric motor (11) is disposed on the drive shaft (1) and is controlled is such a way that upon a rotation of the drive shaft in the first direction, the electric motor effects an additional torque of the drive shaft (1) in the first direction, and upon rotation of the drive shaft in the opposite direction effects a recovery of energy.

11 Claims, 3 Drawing Sheets

FIRING DIRECTION SYSTEM FOR A ROCKET LAUNCHER

BACKGROUND OF THE INVENTION

The invention relates to a firing direction system for a rocket launcher, especially a firing direction system for the adjustment of the rockets during the launching toward a prescribed target.

The functional elements of a conventional firing direction system are illustrated in FIG. 1. The output shaft 10 of a motor 9 drives the input shaft 8 of a safety brake mechanism that automatically closes under load. In the rocket launchers used in the military, the motor is a hydraulic motor. The rocket launcher, which is installed on a vehicle, will be designated in the following as a load. The output shaft 10 of the safety brake mechanism is connected with the load. The load itself is not illustrated in this description.

The function of the safety brake mechanism is to reliably hold the greatly imbalanced, i.e. downwardly driving, load even if the blocking brake on the motor fails or is incorrectly controlled (the blocking brake on the motor is not illustrated in FIG. 1) or if the drive motor fails or functions incorrectly, and to protect against an uncontrolled falling down of the load. Furthermore, during the lowering of the imbalanced load, the brake converts the potential energy into heat, which would otherwise heat up the oil.

An improved hydraulic type of drive is also known for the same use, whereby during the lowering of the load, the oil is conveyed into a pressure tank in order to store the potential energy. In this connection, the counter pressure of this storage means is also used in order to brake or retard the falling-down load when the motor control fails or if there is an incorrect functioning of the motor. Although these drives operate without a safety brake, they maintain the drawback of hydraulics. Hydraulic oil must be removed, the drive efficiency is low, the development of noise is high, and oil is combustible.

Also known is the use of regulated, brushless electric motors for the drive of a rocket launcher. In this connection, however, a brake must be externally controlled in order to achieve the braking effect during stand still, when an incorrect functioning occurs, or upon failure of the motor. This design has not yet been proven with regard to functional reliability, and has not yet been introduced with troops.

The functioning of this safety brake mechanism will be described in detail in the following for the individual operating conditions with the aid of FIG. 1. The invention can, however, also be used with other safety brake mechanisms.

1. Functional description for the state of rest, i.e. the rocket launcher (the load) is to be held in a desired position:

The output shaft 1 of the brake mechanism engages via teeth with an inner plate carrier 2 of a multiple-plate brake. The output shaft 1 and the inner plate carrier 2 can be displaced axially relative to one another; however, in the radial direction the two shafts 1 and 2 are interconnected.

The multiple-plate brake 3, by means of the bias of a torsion spring 4, which rotates the two shafts 2 and 8, is closed by the action of the inclined surfaces 5 and 5'. The outer plate carrier 6 is supported on a return stop 7 that permits no rotation in the direction—load downward. The brake is thereby effective, and the rocket launcher is held in its position.

2. Functional description for the function—motor drives the load upwardly (raising):

The drive shaft 8 is driven by the motor against the effect of the load. The multiple-plate brake is pressed further together by the inclined surfaces 5 and 5' and remains closed as long as the load is directed downwardly. The outer plates of the multiple-plate brake are supported in a plate carrier 6 against rotation. This plate carrier 6 is, in turn, connected with a free-running drive 7. This free-running drive 7 is freely rotatable in the direction—load upwardly. The brake mechanism can thus rotate with the motor in an unobstructed manner and can raise the load.

3. Functional description for the function—motor drives the load downwardly (lowering):

The drive shaft 8, against the bias of the torsion spring 4, rotates the closed brake open to such an extent until the inclined surfaces 5 and 5' release the pressure upon the plates of the brake, and the torque of the brake is less than the torque of the downwardly driving load.

The output shaft 1 can, in this connection, rotate only as rapidly as the shaft 8 is driven. As soon as the load tries to overtake the shaft 8, the brake is closed by the inclined surfaces 5 and 5'.

The reliable support of the load achieved with this mechanism could also be achieved with an automatically arresting gear mechanism that is built into the drive string, or with an automatically arresting spindle or worm. The advantage of the above-described safety brake of the state of the art, relative to such an automatically arresting gear mechanism, is, however, that the described mechanism operates with a considerably better efficiency during the raising of the load than would be the case, for example, with an automatically arresting worm or screw drive.

An important drawback of the above-described embodiment with the safety brake, as well as with every automatically arresting gear mechanism, is, however, that during the lowering of the load, the potential energy that is in the load is completely converted into frictional energy. In this connection, the brake becomes worn and heats up. The wear limits the number of operations of the firing direction system and hence the service life of the brake. The heating of the system also limits the number of successive downward directing processes. Furthermore, the braking effect per unit of time of each frictional brake is limited, as a result of which the speed during the lowering of the load is limited.

In addition, especially with firing direction systems for weapons, it is very important that the directing processes can be carried out with as little development of noise as possible.

It is an object of the present invention to provide a firing direction system for a rocket launcher that avoids the aforementioned drawbacks.

SUMMARY OF THE INVENTION

This object is realized by a firing direction system that comprises a drive motor; a safety brake that connects the drive motor with a drive shaft for adjusting the rocket launcher, wherein a rotation of the drive shaft in a first direction effects a raising of the rocket launcher and a rotation in the opposite direction effects a lowering of the rocket launcher, and wherein the safety brake prevents a back-driving torque of the rocket launcher from effecting a rotation of the drive shaft in the opposite direction; and an electric motor that is disposed on the drive shaft and is controlled in such a way that upon a rotation of the drive shaft in the first direction, the electric motor effects an additional torque of the drive shaft in the first direction, and that upon rotation of the drive shaft in the opposite direction, the electric motor effects a recovery of energy.

Pursuant to the invention, the drive for the adjustment of a weapon system utilizes a safety brake mechanism that automatically closes under load, and an electric motor that is disposed on the output shaft of the safety brake mechanism, whereby the electric motor is controlled in such a way that during the raising of the load it assists the hitherto existing drive, and during the lowering of the load enables a recovery of the energy.

With the firing direction system, which is preferably secured on a vehicle, the energy for the adjustment process is taken from the vehicle battery. The battery is discharged during the raising of the load. Although during the lowering of the load less energy is required from the battery than during raising, conventionally no energy could be returned to the battery. Therefore, after a very short period of time the battery had to be charged by the internal combustion engine of the vehicle, which led to an undesired development of noise. Pursuant to the invention, a rapid discharging of the battery, and an undesired development of noise, can be avoided.

The inventive firing direction system utilizes a conventional safety brake for a maximum security, and also utilizes the advantages of the electrical drive technology.

Pursuant to one advantageous embodiment of the invention, the control of the drive motor is designed in such a way that the motor is used only for the opening of the safety brake during raising, whereas the additional electric motor can be controlled in such a way that it effects the torque for the raising of a load.

Pursuant to an alternative advantageous embodiment, the control of the additional electric motor is embodied is such a way that it effects an additional torque only if particularly high torques are required for raising the load.

Pursuant to a further advantageous embodiment of the invention, the control of the drive motor is embodied is such a way that during the raising and lowering of the load, the motor is controlled with the same regulating principle, whereas the control of an additional electric motor is embodied in such a way that it is controlled with a non-linear regulation principle.

Further advantageous embodiments are provided in the dependent claims.

BRIEF DESCRIPTION OF THE DRAWINGS

In the following, the present invention will be explained with the aid of preferred embodiments in conjunction with the accompanying drawings. In this connection, the drawings show in detail.

DESCRIPTION OF PREFERRED EMBODIMENTS

Figure 1:
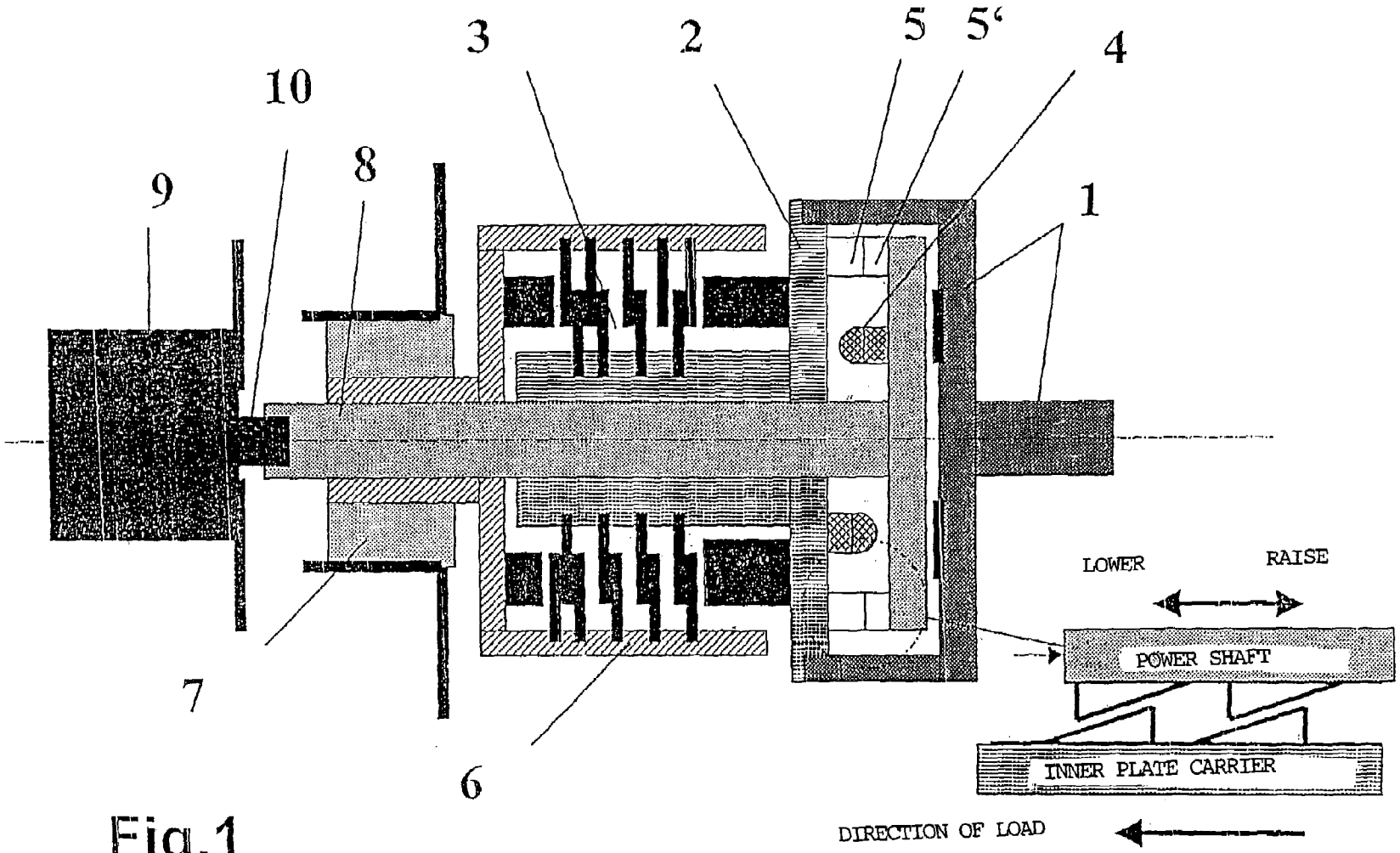
FIG. 1 a cross-sectional view of the construction of a drive of a conventional safety brake for a firing direction system, FIG. 2 a cross-sectional view of an inventively improved drive of a firing direction system, and FIG. 3 a block diagram for the control of an inventive firing direction system having electric motors.
Figure 2:
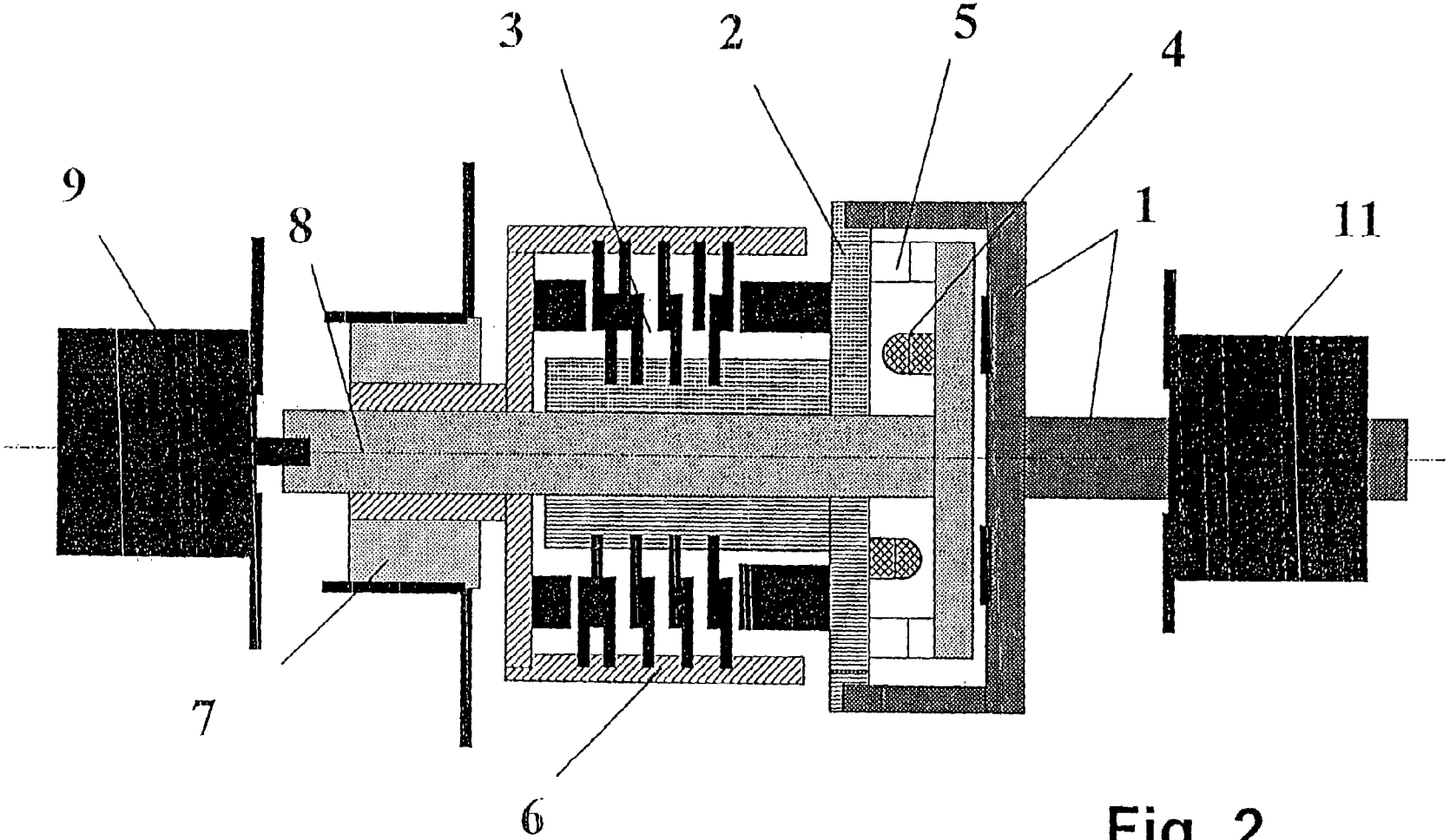

FIG. 2 shows a safety brake according to FIG. 1 with a further motor 11, which acts upon the output shaft 1 of the brake. The state of rest described in the state of the art—holding the load against the weight—is, in this connection, accomplished by the same elements as described in conjunction with FIG. 1. The raising of the weapon is undertaken by both motors 9 and 11. The motor torques are mechanically totaled.

The lowering of the load with the embodiment illustrated in FIG. 2 is advantageously undertaken as follows:

The motor 9 must, as in FIG. 1, open the safety brake by a rotation. In this connection, the downward movement of the load cannot be effected more rapidly than is prescribed by the rotation of the brake by this motor 9. The energy required at the motor 9 is, in this connection, always positive, in other words, the motor requires energy from the power supply in order to open the brake and can, due to the already described function of the safety brake, not operate in generator operation. The drive-back potential energy of the load is converted in the brake into heat.

Pursuant to this invention, the motor 11 is controlled is such a way that during downward movement of the load it operates in generator operation, and at least a portion of the potential energy of the load is fed back into the power supply, i.e. the battery of the firing direction system, preferably the vehicle battery. This arrangement and control relieves the brake, and the vehicle battery can supply the system longer without being recharged. The safety function of the brake is not adversely affected thereby.

Figure 3:
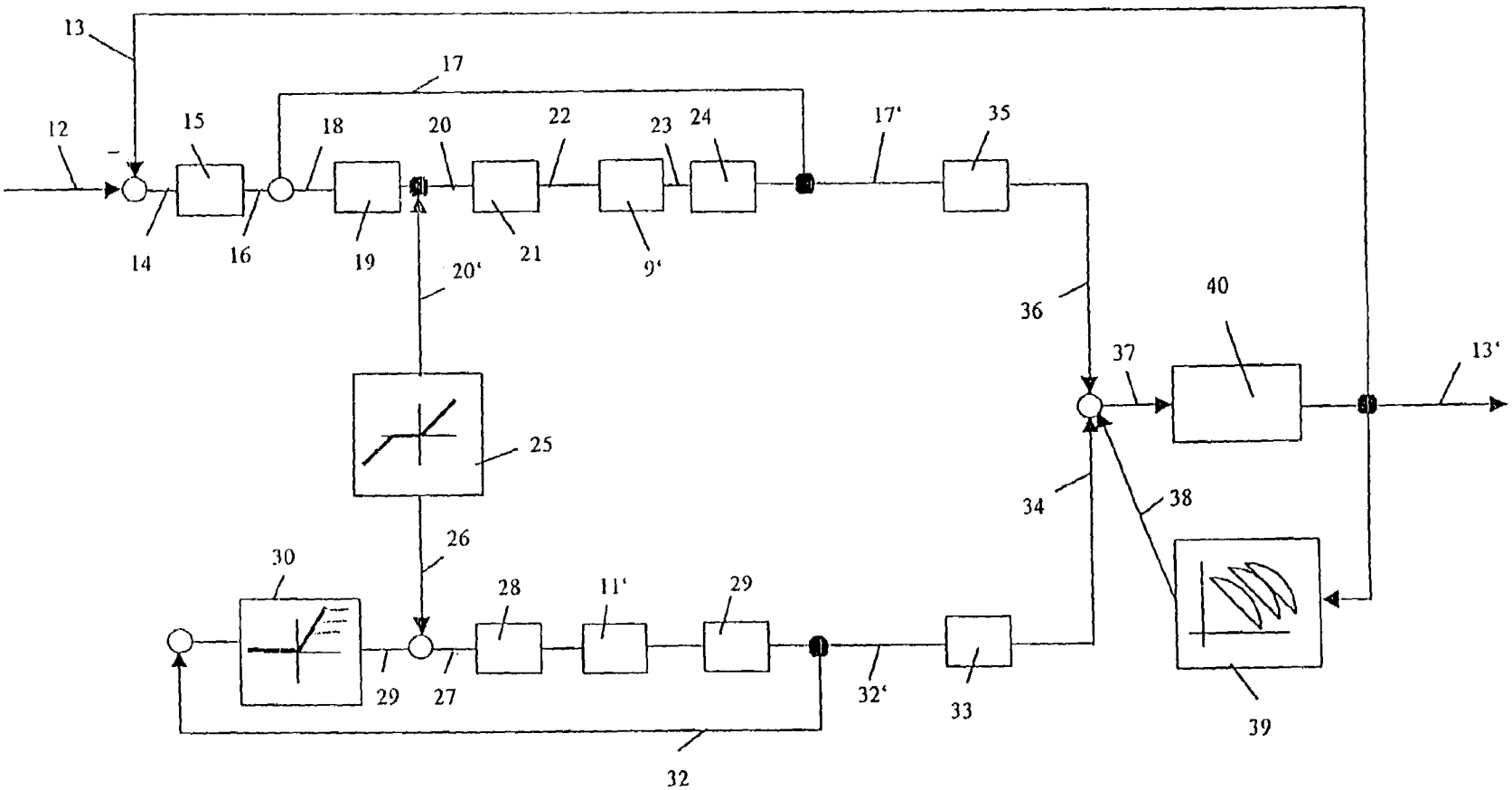

One possibility for connecting and operating together the two drive motors that are connected pursuant to FIG. 2 is described in the following. For the explanation, the block diagram illustrated in FIG. 3 will be utilized. Described in FIG. 3 are the important mechanical and electrical functional elements of the drive system as transfer blocks, as well as the cooperation of the blocks as connecting lines.

A desired or target signal 12 for the position of the rockets during launch or firing, which is calculated, for example, by a firing control computer, provides the position of the load. The actual position 13 of the load is determined by a position sensor (not shown) and is compared with the desired signal 12 in order to calculate a position error signal 14.

The position regulator 15 conveys a signal 16, as a desired speed value 16, that is a function of the magnitude of the position deviation 14. This desired speed value 16 is compared with the motor speed 17 measured at the motor 9'. The difference between the two signals 16 and 17 is conveyed as a speed error signal 18 to the speed regulator 19. In this connection, the motor 9' is identical to the motor 9 illustrated in FIGS. 1 and 2. The speed regulator 19 conveys a signal 20, which is a function of the error signal 18, to the power regulator 21 of the motor 9'. From the power prescribed by the power regulator, the motor 9' produces the motor torque 23 which, depending upon the counter torque applied, causes the output shaft 24 to be rotated with the rotational speed 17.

The regulation of the motor 9' is thus effected pursuant to the known cascade control principle. There are other regulation methods for motors that could also be utilized in order to regulate the speed and the position of the load. These are not described here, but could also be utilized.

The output 22 of the power regulator 21 provides the power that is necessary for the movement of the motor 9'. In this connection, it is immaterial whether the motor is a 3-phase alternating-current or a direct-current motor. The torque 23 of the motor that is given off is, in every case, determined by an electrical current that is associated with the motor. The motor torque 23 is, in the drive shaft of the motor 10 and in the mechanical parts 24 connected therewith, converted into a rotation that is measured as the rotational speed 17 and is compared, as described, with the desired speed value 16 of the motor.

In the system pursuant to this invention, the desired power value signal 20 is conveyed to the control circuit of the second motor 11' via a non-linear signal transfer block 25.

Depending upon the magnitude and the positiveness or negativeness of the desired power value 20', a signal 26 is formed. For positive signals from 20', a signal 26 that is proportional to the signal 20' and that has the same sign as the desired power value 20' is formed. For negative signs of the desired power value 20', up to a certain amount, no signal is conveyed further, subsequently a proportional negative signal.

For positive values of the desired power value 20', there is produced pursuant to this definition in the motor a torque that drives in the direction load upwardly. In this case, in other words positive signal 20', there is provided to the power regulator 28 of the second motor 11'a desired value 26 that is proportional to the signal 20. This positive desired power value 26 effects, by definition, and by the motor 11', at the load a torque that acts in the same upward direction as does the torque of the motor 9'.

The transfer blocks of the control circuit for the motor 11', namely the power regulator 28, the motor 11', and the mechanical components 29 that are connected with the motor 11', effect, as the control circuit already described for the motor 9', the rotation of the motor. The speed of the motor 11' is also measured, and the speed signal 32 is provided to the speed regulator 30 with a negative sign.

As a special feature of the control for the motor 11', described here, no desired speed value is provided to the speed regulator 30, i.e. the desired value is always zero. Furthermore, at positive speeds, i.e. a speed of the motor in the direction load upwardly, the speed regulator 30 conveys no output value 29 to the power regulator 28. In so doing there is achieved that in this direction of rotation, the power regulator 28 prescribes the desired value only from the desired value 26 that is derived from the desired power value of the speed regulator 19.

The torque of the motor 11' is converted by the mechanical components 33 into a torque 34. The torque of the motor 9' is similarly converted by mechanical components 35 into a torque 36. Both torques form a common torque 37 that drives the load. The summed torques 37 of the two motors accelerate the load upwardly if the sum of these torques is greater than the back-driving torques 38 of the load.

The magnitude of the back-driving torques of the load 38 is a function of the position of the load and of the number of rockets disposed on the rocket launcher, as indicated in the transfer block 39.

The design of the control pursuant to this functional example takes into account all load conditions. The behavior of the control will be described in the following for the individual operating states.

1. Operating state—the load is to be moved upwardly:

For both motors 9' and 11', a current is provided that increases until the load is moved upwardly. The speed regulator 30 of the motor 11' does not, in this connection, become effective in the control since the output 29 for this operating state is zero. Both motors conform to the desired value control signal that is produced by the regulators 15 and 19 of the motor 9' as a consequence of the control deviations 14 and 16.

2. Operating state—the load is to be moved downwardly:

A current is prescribed for the motor 9' that suffices to open the safety brake and to rotate into the direction load downwardly. The load follows the speed of the motor 9' and cannot overtake it. The motor 11' is not activated by the signal 26 as long as the load follows the motor speed. The output value of the transfer block 25 remains zero.

However, the motor 11' is driven via the mechanical connection with the load in the direction load downwardly. The speed of the motor 11' is measured and is supplied via the signal 32 to the speed regulator 30. The speed regulator 30 tries to regulate the speed to zero since no desired value is present for the speed. As a result, as a function of the speed in the motor 11', a counter torque to the back-driving load is built up. In this connection, the motor 11' operates in generator operation, i.e. electrical energy is fed back into the battery, and in addition the downward movement of the load is retarded.

The process of feeding energy back for electric motors is known in general and will therefore not be described in detail.

In case the braking effect of the motor 11 becomes so great that the load cannot follow the control signal of the motor 9', the speed error signal 18, and hence the desired power 20', become greater. This increase of the signal 20 is recognized by the transfer block 25, and is provided to the power regulator 28 proportionally to the magnitude of the desired power. In so doing, the braking effect of the motor 11' is reduced until the load can again follow the rotation of the motor 9'.

The specification incorporates by reference the disclosure of German priority document 102 04 052.4 filed Feb. 1, 2002 and PCT/DE03/00220 filed Jan. 28, 2003.

The present invention is, of course, in no way restricted to the specific disclosure of the specification and drawings, but also encompasses any modifications within the scope of the appended claims.

The invention claimed is:

1. A firing direction system for adjusting a rocker launcher, comprising:

a drive motor;

a safety brake connecting said drive motor with a drive shaft for adjusting the rocket launcher, wherein a rotation of the drive shaft in a first direction effects a raising of the rocket launcher and a rotation in an opposite direction effects a lowering of the rocket launcher, and wherein said safety brake prevents a back-driving torque of the rocket launcher from effecting a rotation of the drive shaft in the opposite direction; and an electric motor that is disposed on said drive shaft and is controlled in such a way that upon a rotation of said drive shaft in said first direction, said electric motor effects an additional torque of said drive shaft in said first direction, and that upon rotation of said drive shaft in said opposite direction, said electric motor effects a recovery of energy.

2. A firing direction system according to claim 1, which further comprises a control device that, for a control of said drive motor, is embodied such that said drive motor, for a rotation of said drive shaft in said first direction, effects a constant torque for an opening of said safety brake, and which, for a control of said electric motor, is embodied such that said electric motor effects a torque that is necessary for a rotation of said drive shaft is said first direction for a raising of the rocket launcher.

3. A firing direction system according to claim 1, which further comprises a control device that, for a control of said electric motor, is embodied such that said electric motor is operated only during particularly high torques required for a raising of the rocket launcher.

4. A firing direction system according to claim 1, which further comprises a first control device that, for a control of said electric motor, is embodied such that said electric motor is controlled pursuant to a non-linear control principle, and a second control device that, for a control of said drive motor, is embodied such that said drive motor is controlled in both directions of rotation pursuant to the same control principle.

5. A firing direction system according to claim 1, wherein said drive motor and said electric motor are coupled to said drive shaft with different gear ratios.

6. A firing direction system according to claim 1, wherein said drive motor and said electric motor have different motor characteristics.

7. A firing direction system according to claim 1, wherein control of at least one of said drive motor and said electric motor can be varied as a function of at least one of an angle of direction of the rocket launcher and a loading condition of the rocket launcher.

8. A firing direction system according to claim 1, wherein said drive motor is a hydraulic motor.

9. A firing direction system according to claim 1, wherein said drive motor is an electric motor.

10. A firing direction system according to claim 9, wherein both said drive motor and said electric motor are brushless electric motors.

11. A firing direction system according to claim 9, wherein said drive motor is a direct current motor that has brushes, and wherein said electric motor is a brushless electric motor.

* * * * *